US011291256B1

(12) United States Patent
Davenport

(10) Patent No.: US 11,291,256 B1
(45) Date of Patent: Apr. 5, 2022

(54) IN AND OUT NECKTIE

(71) Applicant: Lawrence Davenport, McDonough, GA (US)

(72) Inventor: Lawrence Davenport, McDonough, GA (US)

( * ) Notice: Subject to any disclaimer, the term of this patent is extended or adjusted under 35 U.S.C. 154(b) by 0 days.

(21) Appl. No.: 17/365,068

(22) Filed: Jul. 1, 2021

(51) Int. Cl.
*A41D 25/00* (2006.01)

(52) U.S. Cl.
CPC ..... *A41D 25/003* (2013.01)

(58) Field of Classification Search
CPC ..... A41D 25/003
USPC ..... 2/144
See application file for complete search history.

(56) References Cited

U.S. PATENT DOCUMENTS 2,100,870 A * 11/1937 Petrie ..... A41D 25/003 2/145
2,918,678 A * 12/1959 Aubreyl ..... A41D 25/00 2/144
D231,959 S * 7/1974 Shah ..... D2/605
3,946,446 A * 3/1976 Schofield ..... A61F 2/3836 623/20.21
5,073,987 A * 12/1991 Crosier ..... A41D 25/00 2/144
5,235,704 A * 8/1993 Collins ..... A41D 25/005 2/145
5,461,726 A * 10/1995 Wade ..... A41D 25/00 2/144
5,815,835 A * 10/1998 Craddock ..... A41D 27/08 2/144
D749,818 S * 2/2016 Hou ..... D2/502
D845,583 S 4/2019 Chiarenza
2012/0080126 A1* 4/2012 Marcin ..... A45F 3/14 150/109
2016/0324232 A1* 11/2016 Cha ..... A41D 25/06
2017/0049169 A1* 2/2017 Tincher ..... A41D 25/08
2017/0265542 A1* 9/2017 Redmond ..... A41D 25/001

FOREIGN PATENT DOCUMENTS

CN 206294940 U 7/2017

* cited by examiner

*Primary Examiner* — Gloria M Hale
(74) *Attorney, Agent, or Firm* — Kilpatrick Townsend & Stockton LLP

(57) ABSTRACT

A necktie system includes a body having a knot portion, a neck support portion, a first hanging portion extending from the knot portion, and a second hanging portion extending from the knot portion in a same direction as the first hanging portion. The first hanging portion includes a front surface, a rear surface, a first end opposite from the knot portion, and an aperture between the knot portion and the first end that extends from the front surface to the rear surface. A width of the aperture is less than a width of the first hanging portion. The second hanging portion covers a portion of the front surface of the first hanging portion from the knot portion of the body to the aperture. The second hanging portion extends through the aperture in the first hanging portion.

16 Claims, 6 Drawing Sheets

IN AND OUT NECKTIE

FIELD OF THE INVENTION

This application relates to articles of clothing, and, more particularly, to neckties.

BACKGROUND

A traditional necktie includes an elongated fabric material that is tied in a knot around a user's neck such that a first end portion and a second end hang down from the knot. When worn, the two end portions may hang freely from each other, the first end portion may have a tab on an inner surface that receives the second end portion to retain the second end portion against the inner surface of the first end portion, or a separate device such as a clip or pin may retain the end portions together. Other than selecting a pattern on the fabric material, traditional neckties do not allow for customization by the user.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments, a necktie system includes a body, and the body includes a first end, a second end opposite from the first end, a first side extending from the first end to the second end, and a second side extending from the first end to the second end and opposite from the first side. The body also includes a first surface and a second surface opposite from the first surface. The body also includes a first portion between the first end and the second end, and the first portion includes a maximum width. The body may also include a second portion between the first portion and the second end. In certain embodiments, the maximum width of the first portion is greater than a maximum width of the second portion, and a length of the second portion is greater than a length of the first portion. In various embodiments, the necktie system includes a plurality of apertures defined in the first portion of the body and extending through the first portion of the body from the first surface to the second surface. In some embodiments, each aperture includes a first end and a second end opposite from the first end, a distance from the first end to the second end of each aperture is a width of the aperture, and the width of each aperture is less than the width of the first portion. In various embodiments, a portion of the first surface is between each first end of the plurality of apertures and the first side of the body, and a portion of the first surface is between each second end of the plurality of apertures and the second side of the body. Each aperture may receive the second portion of the body such that the second portion of the body extends through the first portion of the body. The necktie system may be worn around a neck of a user.

In some embodiments, a width of the first portion is not constant between the second portion and the first end. In certain embodiments, each aperture of the plurality of apertures is spaced apart from an adjacent aperture by a predetermined distance, and the predetermined distance is greater than the width of each aperture. In some cases, the predetermined distance is from 2.5 inches to 3 inches.

In various embodiments, the plurality of apertures includes four apertures. In certain embodiments, the maximum width of the first portion is 4 inches. According to some examples, each aperture of the plurality apertures is orthogonal to a central axis of the body extending from the first end to the second end.

In certain embodiments, the maximum width of the first portion is at least double the maximum width of the second portion. In some examples, the length of the second portion is at least 1.5 times the length of the first portion. In various cases, a width of each aperture of the plurality of apertures is the same. In some embodiments, the first surface is a front surface of the body and the second surface is a rear surface of the body.

According to certain embodiments, a necktie system includes a body that includes a knot portion, a neck support portion extending from the knot portion and configured to support the necktie system proximate to a neck of a user when worn, a first hanging portion extending from the knot portion, and a second hanging portion extending from the knot portion in a same direction as the first hanging portion. In certain embodiments, the first hanging portion includes a front surface, a rear surface, a first end opposite from the knot portion, and an aperture between the knot portion and the first end and extending from the front surface to the rear surface. A width of the aperture may be less than a width of the first hanging portion. In various embodiments, the second hanging portion includes a front surface, a rear surface, and a second end opposite from the knot portion, and the second hanging portion covers a portion of the front surface of the first hanging portion from the knot portion of the body to the aperture. The second hanging portion may extend through the aperture in the first hanging portion, and a width of the second hanging portion is less than the width of the first hanging portion.

In some embodiments, the aperture is a first aperture, and the first hanging portion includes a plurality of apertures between the knot portion and the first end. Each aperture of the plurality of apertures may be spaced apart from an adjacent aperture by a predetermined distance, and the predetermined distance may be greater than a width of each aperture. In some embodiments, the predetermined distance is from 2.5 inches to 3 inches. In certain embodiments, a width of each aperture of the plurality of apertures is the same.

In various embodiments, the width of the first hanging portion is not constant. In some cases, a maximum width of the first hanging portion is 4 inches. In various examples, the aperture is orthogonal to a central axis of the first hanging portion of the body. In some examples, a maximum width of the first portion is at least double a maximum width of the second portion. In certain examples, the front surface of the first hanging portion comprises a first visual characteristic, and the front surface of the second hanging portion comprises a second visual characteristic that is different from the first visual characteristic.

Various implementations described in the present disclosure can include additional systems, methods, features, and advantages, which can not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others are intended to refer to the orientation as illustrated and described in the figure (or figures) to which the components and directions are referencing.

Described herein are necktie systems that may be worn around the neck of a user. In certain embodiments, the necktie systems include a body having a first portion, a second portion, and one or more apertures that are defined in the first portion such that the second portion may be inserted through the first portion in a front-to-back direction. In some aspects, the first portion includes a plurality of apertures, and the second portion may be inserted through the apertures in various patterns as desired to generate a distinct visual appearance for the necktie system. In some embodiments, the first portion may include a first visual characteristic and the second portion may include a second visual characteristic that is different from the first visual characteristic to provide additional visual appearances. Visual characteristics may include, but are not limited to, a color (e.g., red, blue, green, yellow, etc.), a pattern (e.g., stripes, chevrons, checks, etc.), graphic images, highlighting, combinations thereof, or additional characteristics as desired. In various embodiments, when the necktie system is assembled, the second portion may optionally cover a front surface of the first portion between a knot in the necktie and the aperture defined in the first portion. In such optional embodiments, at least a portion of the first portion and at least a portion of the second portion may always be visible when the necktie system is assembled and/or worn by a user. Other benefits and advantages may be realized with the necktie systems described herein, and the aforementioned examples should not be considered limiting.

Figure 1:
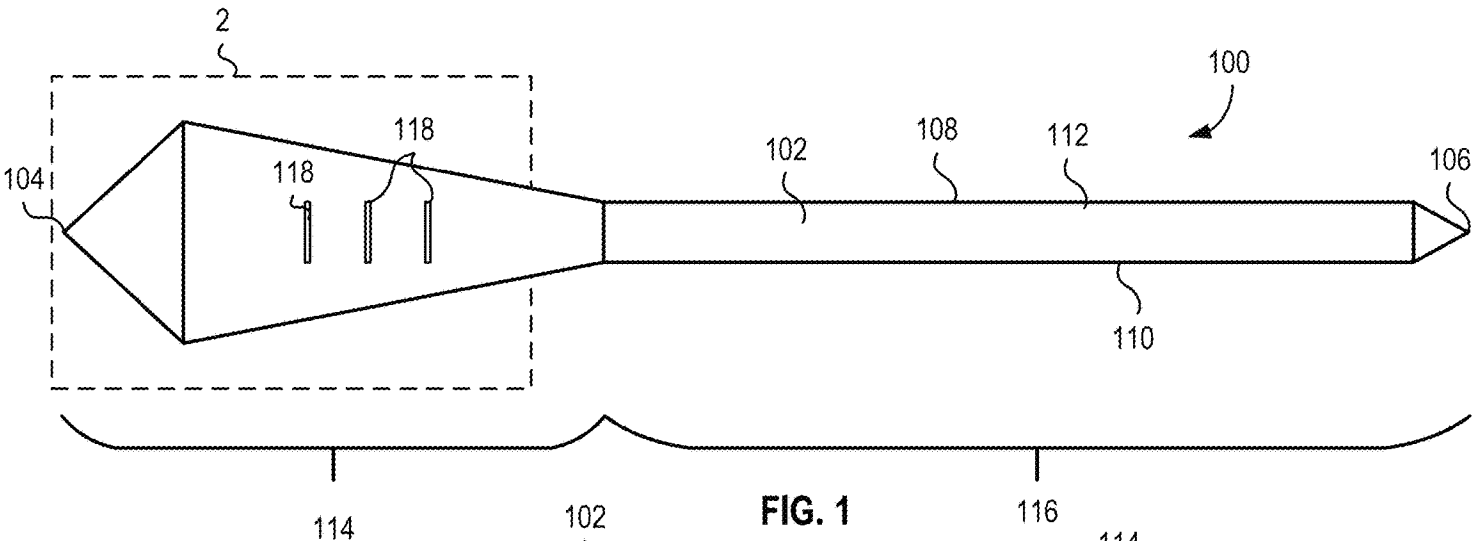
FIG. 1 is a front view of a necktie system according to embodiments of the disclosure.
Figure 2:
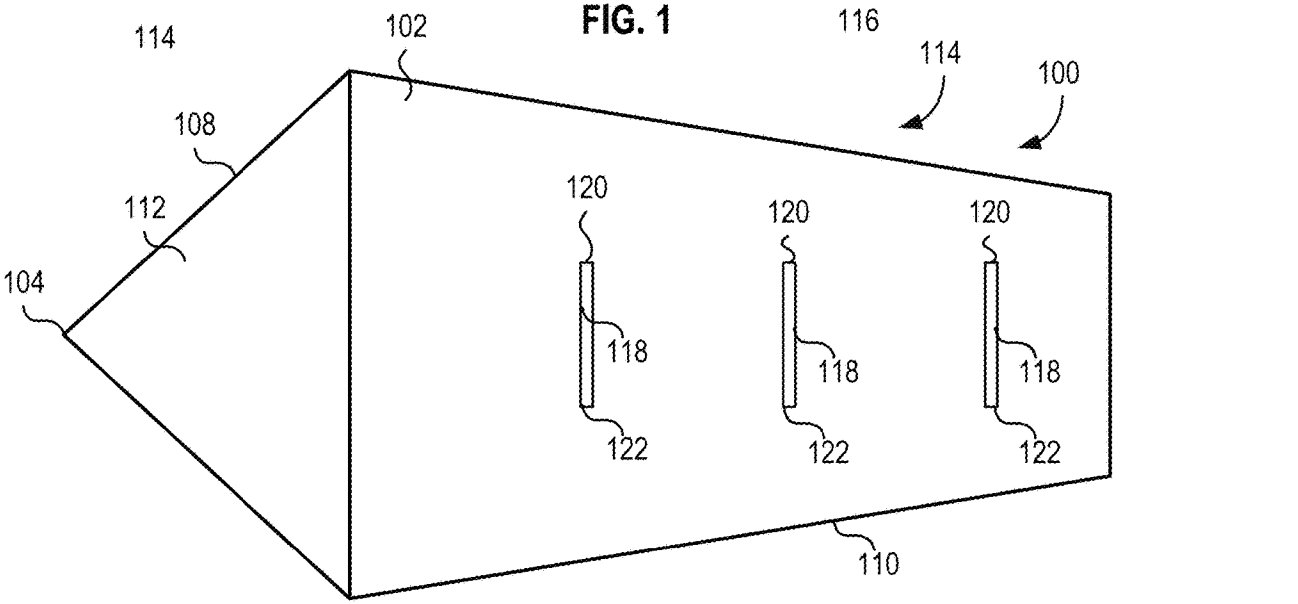
FIG. 2 is a front view of the necktie system of FIG. 1 taken from box 2 in FIG. 1.

FIGS. 1 and 2 illustrate an example of a necktie system 100 according to various embodiments. As illustrated, the necktie system includes a body 102 having a first end 104, a second end 106 opposite from the first end 104, a first side 108 extending from the first end 104 to the second end 106, and a second side 110 opposite from the first side 108. The body 102 includes a first (or front) surface 112 and a second (or rear) surface 113 (see FIG. 5) opposite from the first surface 112. A width of the body 102 is a distance between the first side 108 and the second side 110.

A first portion 114 of the body 102 is between the first end 104 and the second end 106, and a second portion 116 of the body 102 is between the first portion 114 and the second end 106. In certain embodiments, a maximum width of the first portion 114 of the body 102 is greater than a maximum width of the second portion 116 of the body 102. In certain optional embodiments, the maximum width of the first portion 114 is more than double the maximum width of the second portion 116. In one non-limiting embodiment, the maximum width of the second portion 116 may be about 1.25 inches, and the maximum width of the first portion 114 may be about 4 inches, although other maximum widths for the first portion 114 and/or the second portion 116 may be utilized in other embodiments. In some embodiments, the location along the first portion 114 that defines the maximum width of the first portion 114 may be closer to the first end 104 than to the second portion 116, although it need not be in other embodiments.

In various embodiments, a length of the first portion 114, or a distance from the first end 104 to the second portion 116, is less than a length of the second portion 116, or a distance from the second end 106 to the first portion 114. In other words, contrary to traditional neckties where the fatter or wider portion of the necktie is the longest portion, the necktie system 100 provided herein may be designed so the wider portion (e.g., first portion 114) is the shorter portion of the body 102. In some optional embodiments, the length of the second portion 116 is at least 1.5 times the length of the first portion 114. In one non-limiting embodiment, the length of the second portion 116 may be about 39 inches and the length of the first portion 114 may be about 23 inches. In another non-limiting embodiment, the length of the second portion 116 may be about 36 inches and the length of the first portion 114 may be about 22 inches. In certain optional embodiments, the length of the second portion 116 being at least 1.5 times the length of the first portion 114 may allow for the second portion 116 to have sufficient length to form a knot with the first portion 114 (discussed in detail below) and may also allow for the second portion 116 to have a sufficient length to be inserted through the first portion 114 while maintaining its positioning relative to the first portion (also discussed in detail below).

In certain embodiments, the first portion 114 includes at least one aperture 118 that extends from the front surface 112 to the rear surface 113 of the body 102. As discussed in greater detail below with reference to FIG. 4, the at least one aperture 118 is adapted to receive the second portion 116 of the body 102 such that the second portion 116 of the body 102 extends through the first portion 114 of the body 102. In certain embodiments the first portion 114 includes a plurality of apertures 118, each of which extends from the front surface 112 to the rear surface 113 of the body 102. In the embodiment of FIGS. 1 and 2, the first portion 114 includes three apertures 118, but the number of apertures 118 illustrated in FIGS. 1 and 2 should not be considered limiting. In various embodiments, the apertures 118 may be aligned along a central axis of the body 102 that extends from the first end 104 to the second end 106, In certain embodiments, one or more apertures 118 may be orthogonal to the central axis of the body 102, although in other embodiments they need not be.

As best illustrated in FIG. 2, each aperture 118 includes a first end 120 and a second end 122 opposite from the first end 120. and the second end 122 is proximate to the second side 110 of the body 102. A distance from the first end 120 to the second end 122 is a width of the particular aperture 118. In embodiments with a plurality of apertures 118, the apertures 118 may have the same width, or the width of one aperture 118 may be different from the width of another aperture 118. In various embodiments, the width of each aperture 118 is less than the width of the first portion 114. In certain embodiments, the width of each aperture 118 may be greater than the width of the second portion 116.

At least a portion of the front surface 112 (and the rear surface 113) is between the first end 120 of each aperture 118 and the first side 108, and similarly at least a portion of the front surface 112 (and the rear surface 113) is between the second end 122 of each aperture 118 and the second side 110. The portions of the body 102 (e.g., the front surface 112 and the rear surface 113) between the ends 120, 122 of the apertures and the sides 108, 110 of the body 102, respectively, may strengthen the apertures 118, may improve positioning of the second portion 116 both within the apertures 118 and relative to the first portion 114, and/or may optionally generate a distinct visual characteristic where a visual characteristic of the first portion 114 is adjacent to a visual characteristic of the second portion 116.

In embodiments with a plurality of apertures 118, each aperture 118 may be spaced apart from an adjacent aperture 118 by a predetermined distance. In certain embodiments, the predetermined distance is greater that the width of the apertures 118. In various embodiments, the predetermined distance between adjacent apertures 118 is greater than the width of the second portion 116. Optionally, the predetermined distance between adjacent apertures 118 is less than the maximum width of the first portion 114. In one non-limiting embodiment, the predetermined distance between adjacent apertures 118 may be about 2.5 inches. In another non-limiting embodiment, the predetermined distance between adjacent apertures may be about 3 inches. In other optional embodiments, the predetermined distance between a first pair of apertures 118 may be the same as or different from the predetermined distance between a second pair of apertures 118.

Figure 3:
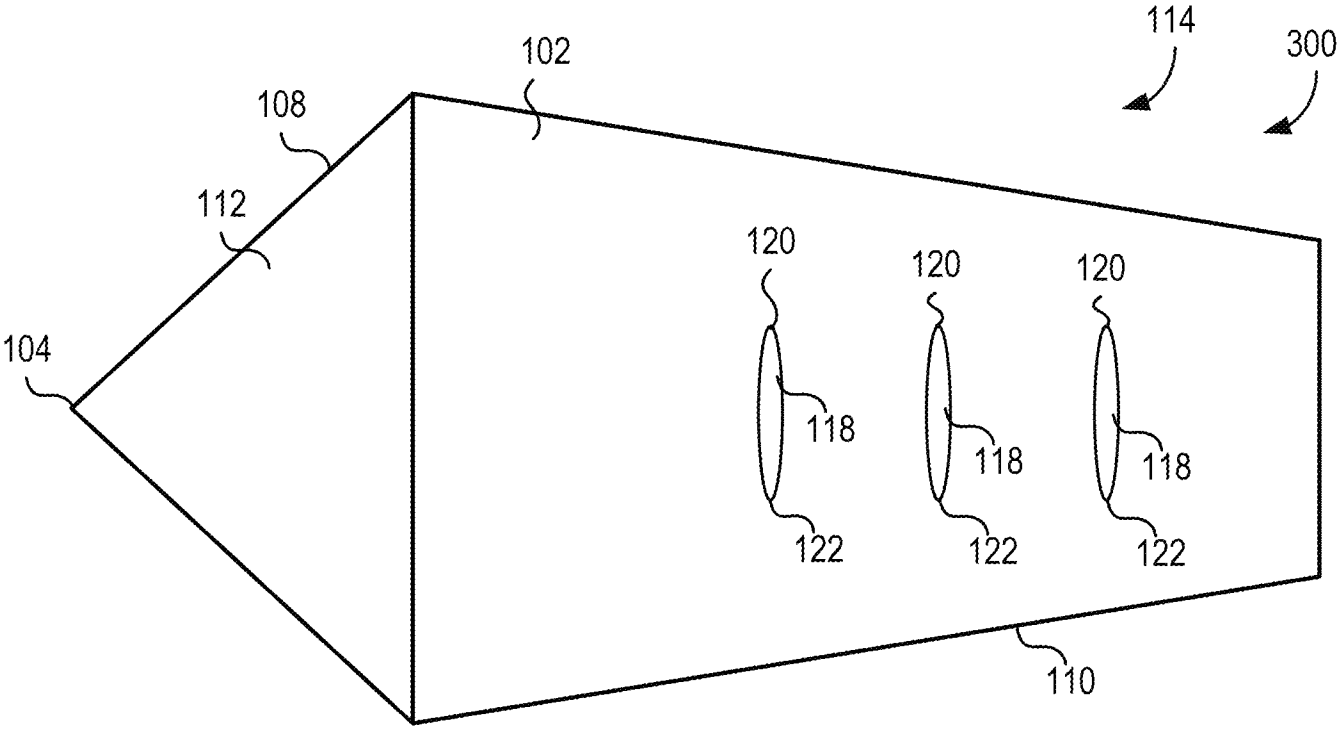
FIG. 3 is a front view of a portion of another necktie system according to embodiments of the disclosure.

The apertures 118 may have various profiles or shapes as desired. As one non-limiting embodiment, the apertures 118 of FIGS. 1 and 2 are squared and/or include sharp edges. As another non-limiting embodiment, FIG. 3 illustrates a portion of a necktie system 300 that is substantially similar to the necktie system 100 except that the apertures 118 are oval. Various other shapes or profiles of the apertures 118 may be utilized as desired. In embodiments with a plurality of apertures 118, the shape or profile of one aperture 118 need not be the same as the shape or profile of another aperture 118.

Figure 4:
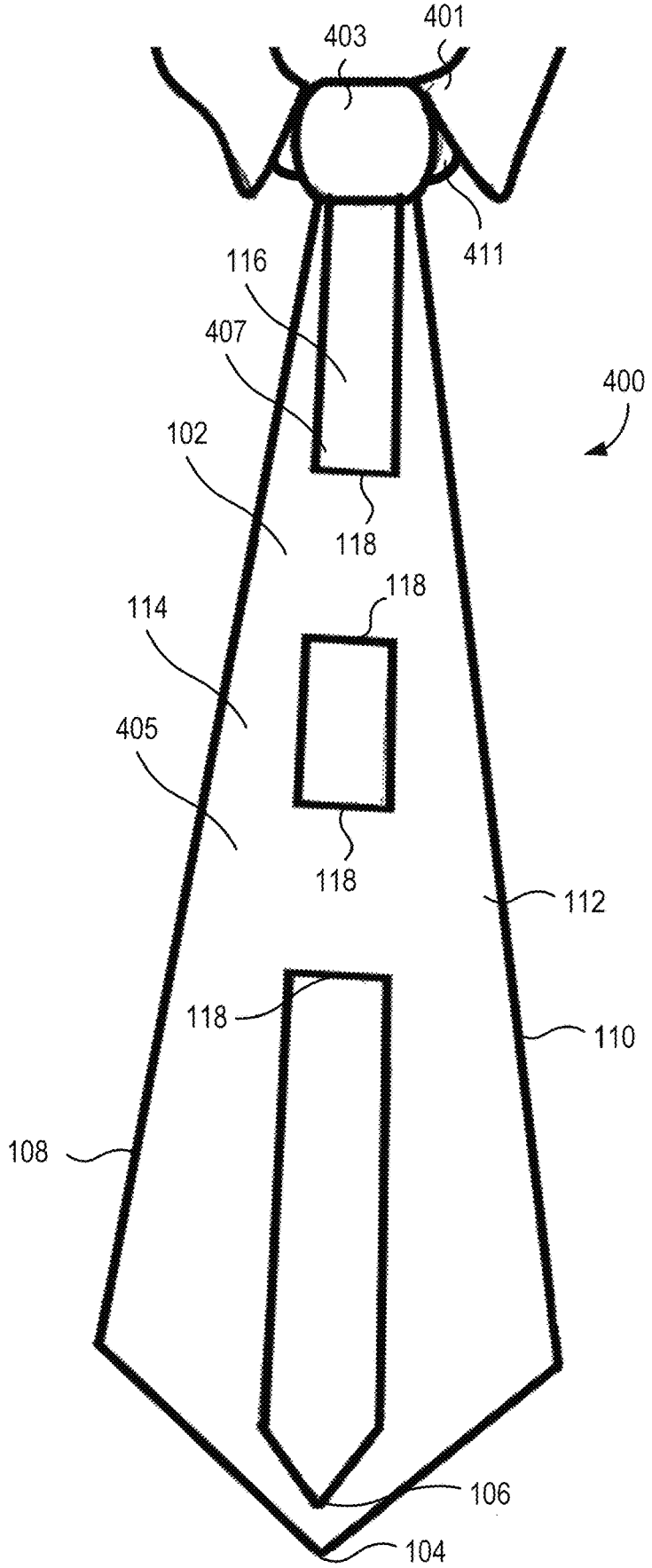
FIG. 4 is a front view of a portion of an assembled necktie system according to various embodiments.
Figure 5:
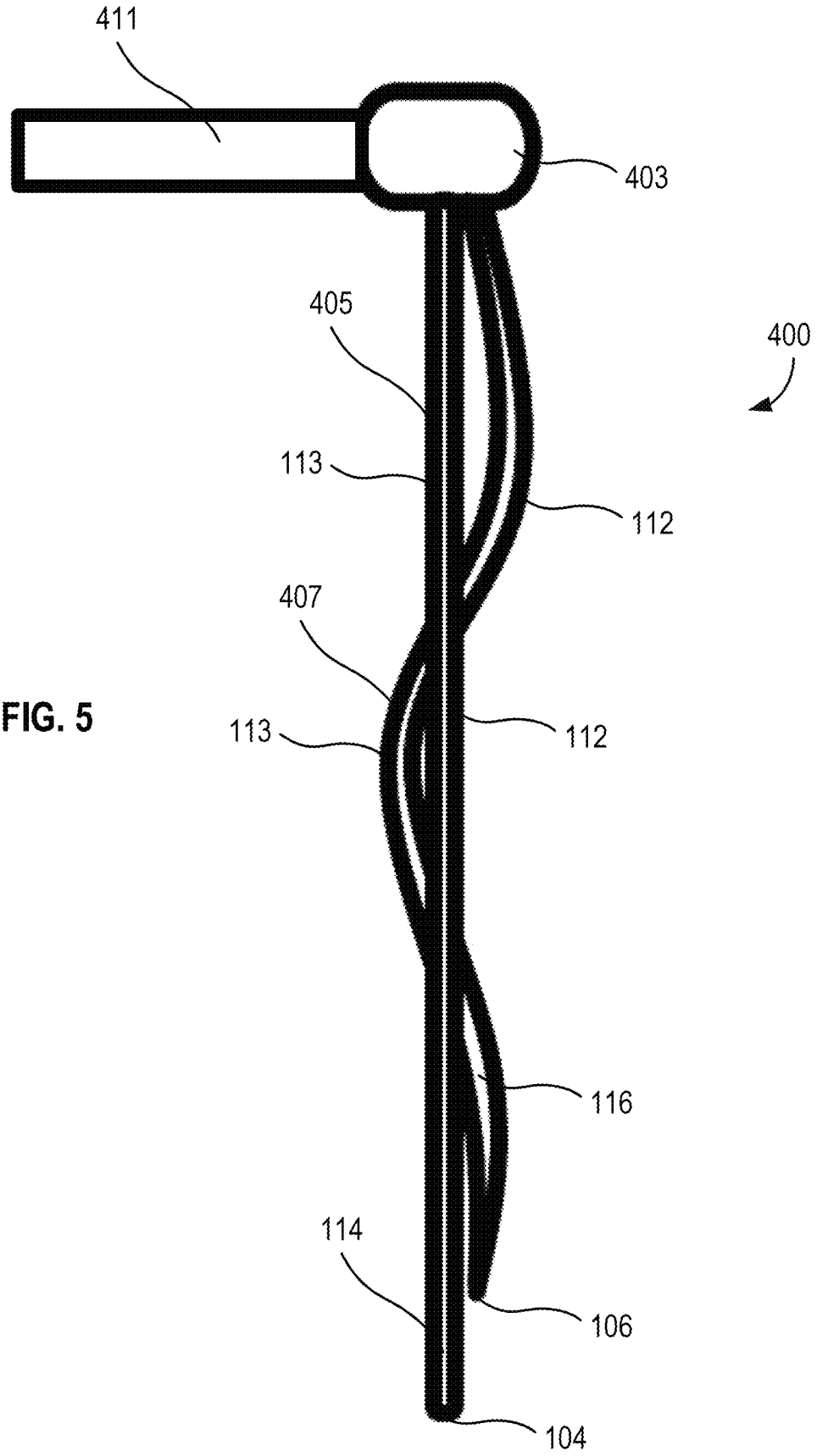
FIG. 5 is a side view the assembled necktie of FIG. 4.

FIGS. 4 and 5 illustrate an embodiment of an assembled necktie system 400 with an article of clothing 401. The article of clothing 401 should not be considered limiting on the disclosure. The necktie system 400 is substantially similar to the necktie system 100 except that the necktie system 400 includes four apertures 118.

The assembled necktie system 400 may be worn around the neck of a user. As illustrated in FIG. 4, when the necktie system 400 is assembled, the body 102 includes a knot portion 403, a neck support portion 411 that extends from the knot portion 403, a first hanging portion 405 extending from the knot portion 403, and a second hanging portion 407 extending from the knot portion 403.

In some embodiments, the neck support portion 411 of the assembled necktie system 400 is configured to support the necktie system 400 on the neck of the user when worn. The neck support portion 411 may extend around at least a portion of the neck of the user when worn. In some embodiments, the neck support portion 411 is continuous and defines a closed perimeter that extends around the neck of the user when worn. In other embodiments, the neck support portion 411 need not be continuous and may have attachment features that may engage with each other and/or an article of clothing of the user to support the necktie system. In such embodiments, the attachment features may be utilized to selectively assemble or disassemble the necktie system 400 on the neck of the user without having to undo the knot portion 403 itself and/or the hanging portions 405, 407 relative to the knot portion 403. Optionally, and as illustrated in FIG. 4, if the article of clothing 401 has a collar, the neck support portion 411 may optionally be tucked under the collar if so desired by the user. The first hanging portion 405 may be at least a portion of the first portion 114 of the body 102, and the second hanging portion 407 may be at least a portion of the second portion 116 of the body 102.

As illustrated in FIG. 4, the second hanging portion 407 covers a portion of the front surface 112 of the first hanging portion 405 from the knot portion 403 of the body 102 to the first aperture 118. As best illustrated in FIG. 5, the second hanging portion 407 may be inserted through the first aperture 118 (e.g., in a front to back direction) such that the first hanging portion 405 covers at least a portion of the front surface 112 of the second hanging portion 407. In various embodiments, the second hanging portion 407 may optionally be inserted through another one of the apertures 118 (e.g., in a back to front direction) such that the second hanging portion 407 again covers a portion of the front surface 112 of the first hanging portion 405. While FIGS. 4 and 5 illustrate the second hanging portion 407 being sequentially inserted through the apertures 118, the second hanging portion 407 may be inserted through the apertures 118 in any order or sequence as desired to generate a desired visual appearance. As a non-limiting example, in another embodiment, the second hanging portion 407 may be inserted through every other aperture 118.

Figure 6:
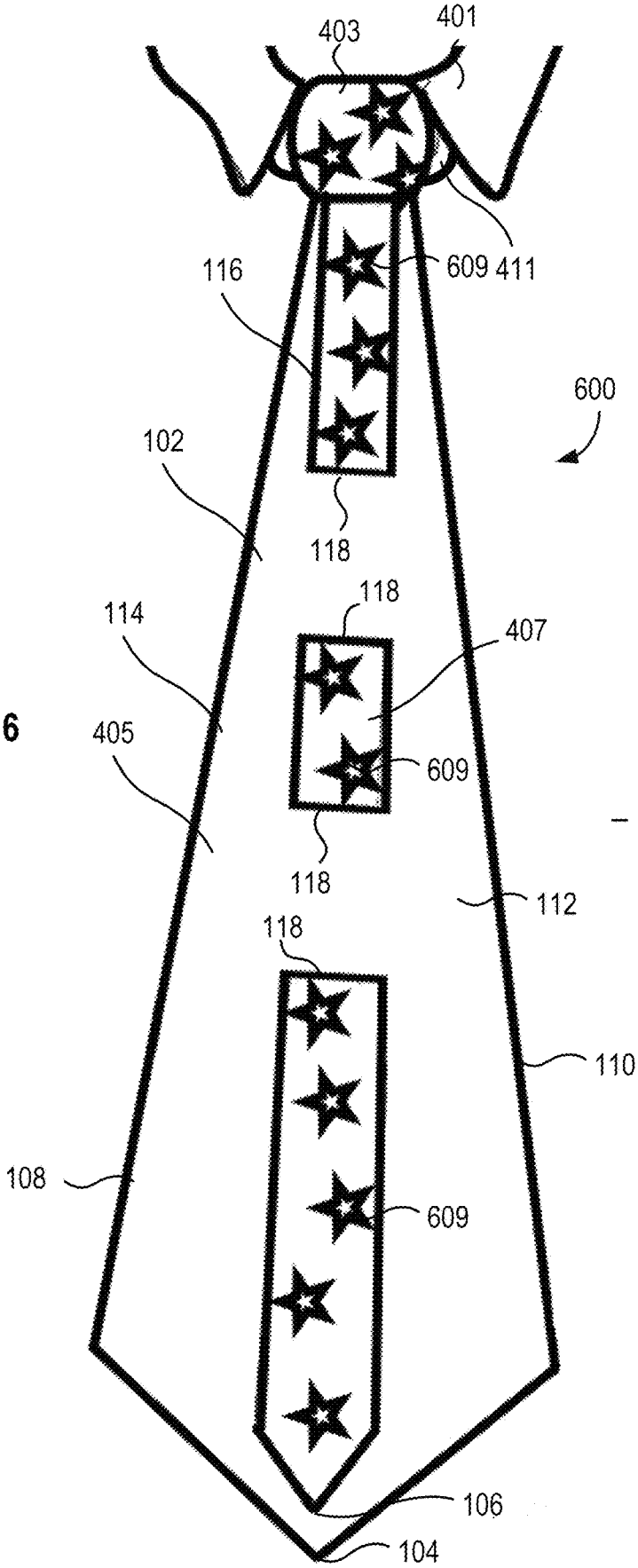
FIG. 6 is a front view of an assembled necktie system according to various embodiments.

FIG. 6 illustrates another assembled necktie system 600 according to various embodiments. The assembled necktie system 600 is substantially similar to the assembled necktie system 400 except that the second hanging portion 407 includes a graphic 609 as a visual characteristic that is different from a visual characteristic of the first hanging portion 405, which in FIG. 6 is a solid color. As previously discussed, various other visual characteristics may optionally be used for the second hanging portion 407 and/or the first hanging portion 405 to generate various visual appearances as desired.

Figure 7:
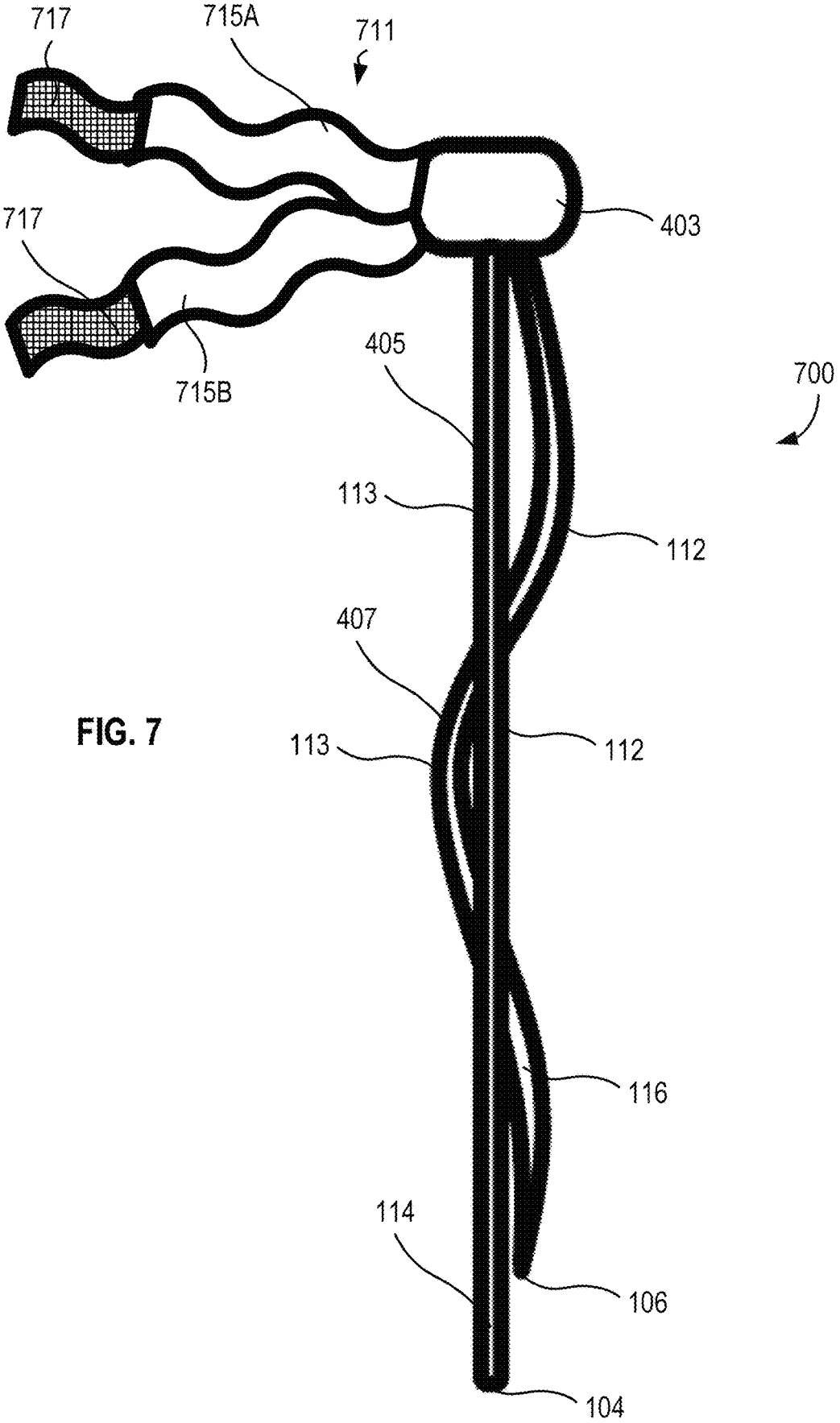
FIG. 7 is a side view of an assembled necktie system according to various embodiments.

FIG. 7 illustrates another assembled necktie system 700 according to various embodiments. The necktie system 700 is substantially similar to the necktie system 400 except that the necktie system 700 includes a discontinuous neck support portion 711 with two sub-portions 715A-B, each of which includes an attachment feature 717. In this embodiment, each sub-portion 715A-B extends along a portion of the user of the necktie system 700 when the necktie system 700 is worn. The attachment features 717 may be various suitable features or mechanisms that may selectively engage each other and/or an article of clothing of the user to support the necktie system 700 on the user. The attachment features 717 may also be detached from each other and/or the article of clothing of the user such that the necktie system 700 can be removed by the user without having to undo the knot portion 403 and/or without having to undo or change the hanging portions 405, 407 relative to each other and/or relative to the knot portion 403. In the embodiment of FIG. 7, the attachment features 717 are hook and loop fasteners; however, in other embodiments, other suitable attachment features may be utilized as desired, including but not limited to clips, clasps, hooks, pins, bands, buttons, adhesives, combinations thereof, or other materials or features as desired.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A necktie system comprising: a body comprising: a first end; a second end opposite from the first end; a first side extending from the first end to the second end; a second side extending from the first end to the second end and opposite from the first side; a first surface; a second surface opposite from the first surface; a first portion between the first end and the second end comprising a maximum width; and a second portion between the first portion and the second end, wherein the maximum width of the first portion is greater than a maximum width of the second portion, and wherein a length of the second portion is greater than a length of the first portion; and a plurality of apertures defined in the first portion of the body and extending through the first portion of the body from the first surface to the second surface, wherein: each aperture comprises a first end and a second end opposite from the first end; a distance from the first end to the second end of each aperture is a width of the aperture, and the width of each aperture is less than the width of the first portion; a portion of the first surface is between each first end of the plurality of apertures and the first side of the body; a portion of the first surface is between each second end of the plurality of apertures and the second side of the body; each aperture is adapted to receive the second portion of the body such that the second portion of the body extends through the first portion of the body; and the necktie system is configured to be worn proximate to a neck of a user.

Illustration 2. The necktie system of any preceding or subsequent illustrations or combination of illustrations, wherein a width of the first portion is not constant between the second portion and the first end.

Illustration 3. The necktie system of any preceding or subsequent illustrations or combination of illustrations, wherein each aperture of the plurality of apertures is spaced apart from an adjacent aperture by a predetermined distance, and wherein the predetermined distance is greater than the width of each aperture.

Illustration 4. The necktie system of any preceding or subsequent illustrations or combination of illustrations, wherein the predetermined distance is from 2.5 inches to 3 inches.

Illustration 5. The necktie system of any preceding or subsequent illustrations or combination of illustrations, wherein the plurality of apertures comprises at least four apertures.

Illustration 6. The necktie system of any preceding or subsequent illustrations or combination of illustrations, wherein the maximum width of the first portion is 4 inches.

Illustration 7. The necktie system of any preceding or subsequent illustrations or combination of illustrations, wherein each aperture of the plurality apertures is orthogonal to a central axis of the body extending from the first end to the second end.

Illustration 8. The necktie system of any preceding or subsequent illustrations or combination of illustrations, wherein the maximum width of the first portion is at least double the maximum width of the second portion.

Illustration 9. The necktie system of any preceding or subsequent illustrations or combination of illustrations, wherein the length of the second portion is at least 1.5 times the length of the first portion.

Illustration 10. The necktie system of any preceding or subsequent illustrations or combination of illustrations, wherein a width of each aperture of the plurality of apertures is the same.

Illustration 11. The necktie system of any preceding or subsequent illustrations or combination of illustrations, wherein the first surface is a front surface of the body and the second surface is a rear surface of the body.

Illustration 12. A necktie system comprising: a body comprising a knot portion, a neck support portion extending from the knot portion and configured to support the necktie system proximate to a neck of the user when worn, a first hanging portion extending from the knot portion, and a second hanging portion extending from the knot portion in a same direction as the first hanging portion, wherein the first hanging portion comprises a front surface, a rear surface, a first end opposite from the knot portion, and an aperture between the knot portion and the first end and extending from the front surface to the rear surface, wherein a width of the aperture is less than a width of the first hanging portion, wherein the second hanging portion comprises a front surface, a rear surface, and a second end opposite from the knot portion, wherein the second hanging portion covers a portion of the front surface of the first hanging portion from the knot portion of the body to the aperture, wherein the second hanging portion extends through the aperture in the first hanging portion, and wherein a width of the second hanging portion is less than the width of the first hanging portion.

Illustration 13. The necktie system of any preceding or subsequent illustrations or combination of illustrations, wherein the aperture is a first aperture, and wherein the first hanging portion comprises a plurality of apertures between the knot portion and the first end.

Illustration 14. The necktie system of any preceding or subsequent illustrations or combination of illustrations, wherein each aperture of the plurality of apertures is spaced apart from an adjacent aperture by a predetermined distance, and wherein the predetermined distance is greater than a width of each aperture.

Illustration 15. The necktie system of any preceding or subsequent illustrations or combination of illustrations, wherein the predetermined distance is from 2.5 inches to 3 inches.

Illustration 16. The necktie system of any preceding or subsequent illustrations or combination of illustrations, wherein a width of each aperture of the plurality of apertures is the same.

Illustration 17. The necktie system of any preceding or subsequent illustrations or combination of illustrations, wherein the width of the first hanging portion is not constant.

Illustration 18. The necktie system of any preceding or subsequent illustrations or combination of illustrations, wherein a maximum width of the first hanging portion is 4 inches.

Illustration 19. The necktie system of any preceding or subsequent illustrations or combination of illustrations, wherein the front surface of the first hanging portion comprises a first visual characteristic, and wherein the front surface of the second hanging portion comprises a second visual characteristic that is different from the first visual characteristic.

Illustration 20. The necktie system of any preceding or subsequent illustrations or combination of illustrations, wherein a maximum width of the first portion is at least double a maximum width of the second portion.

Illustration 21. The necktie system of any preceding or subsequent illustrations or combination of illustrations, wherein the neck support portion defines a closed perimeter.

Illustration 22. The necktie system of any preceding or subsequent illustrations or combination of illustrations, wherein the neck support portion comprises two sub-portions, and wherein each sub-portion comprises an attachment feature, and wherein the attachment feature of one sub-portion is selectively engageable with the attachment feature of the other sub-portion.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A necktie system comprising:

a body comprising:

a first end;

a second end opposite from the first end;

a first side extending from the first end to the second end;

a second side extending from the first end to the second end and opposite from the first side;

a first surface;

a second surface opposite from the first surface;

a first portion between the first end and the second end comprising a maximum width; and a second portion between the first portion and the second end, wherein the maximum width of the first portion is greater than a maximum width of the second portion, and wherein a length of the second portion is greater than a length of the first portion; and a plurality of apertures defined in the first portion of the body and extending through the first portion of the body from the first surface to the second surface, wherein:

each aperture comprises a first end and a second end opposite from the first end;

a distance from the first end to the second end of each aperture is a width of the aperture, and the width of each aperture is less than the width of the first portion;

a portion of the first surface is between each first end of the plurality of apertures and the first side of the body;

a portion of the first surface is between each second end of the plurality of apertures and the second side of the body;

each aperture is adapted to receive the second portion of the body such that the second portion of the body extends through the first portion of the body;

the necktie system is configured to be worn proximate to a neck of a user;

each aperture of the plurality of apertures is spaced apart from an adjacent aperture by a predetermined distance that is greater than the width of each aperture; and the length of the second portion is at least 1.5 times the length of the first portion.

2. The necktie system of claim 1, wherein a width of the first portion is not constant between the second portion and the first end.

3. The necktie system of claim 1, wherein the predetermined distance is from 2.5 inches to 3 inches.

4. The necktie system of claim 1, wherein the plurality of apertures comprises at least four apertures.

5. The necktie system of claim 1, wherein the maximum width of the first portion is 4 inches.

6. The necktie system of claim 1, wherein each aperture of the plurality apertures is orthogonal to a central axis of the body extending from the first end to the second end.

7. The necktie system of claim 1, wherein the maximum width of the first portion is at least double the maximum width of the second portion.

8. The necktie system of claim 1, wherein a width of each aperture of the plurality of apertures is the same.

9. The necktie system of claim 1, wherein the first surface is a front surface of the body and the second surface is a rear surface of the body.

10. A necktie system comprising:

a body comprising a knot portion, a neck support portion extending from the knot portion and configured to support the necktie system proximate to a neck of a user when worn, a first hanging portion extending from the knot portion, and a second hanging portion extending from the knot portion in a same direction as the first hanging portion, wherein the first hanging portion comprises a front surface, a rear surface, a first end opposite from the knot portion, and a plurality of apertures between the knot portion and the first end and extending from the front surface to the rear surface, wherein a width of each aperture is less than a width of the first hanging portion, wherein each aperture of the plurality of apertures is spaced apart from an adjacent aperture by a predetermined distance that is greater than a width of each aperture, wherein the second hanging portion comprises a front surface, a rear surface, and a second end opposite from the knot portion, wherein the second hanging portion covers a portion of the front surface of the first hanging portion from the knot portion of the body to an aperture of the plurality of apertures nearest to the knot portion, wherein the second hanging portion extends through the aperture in the first hanging portion, and wherein a width of the second hanging portion is less than the width of the first hanging portion, and wherein the neck support portion comprises two sub-portions extending away from the knot portion, and wherein each sub-portion comprises an attachment feature opposite the knot portion, and wherein the attachment feature of one sub-portion is selectively engageable with the attachment feature of the other sub-portion and such that the necktie system is removable without changing the first hanging portion and the second hanging portion relative to the knot portion.

11. The necktie system of claim 10, wherein the aperture is a first aperture, and wherein the first hanging portion comprises a plurality of apertures between the knot portion and the first end.

12. The necktie system of claim 10, wherein the neck support portion defines a closed perimeter when the attachment features of the sub-portions are engaged.

13. The necktie system of claim 10, wherein a width of each aperture of the plurality of apertures is the same.

14. The necktie system of claim 10, wherein the width of the first hanging portion is not constant.

15. The necktie system of claim 10, wherein the front surface of the first hanging portion comprises a first visual characteristic, and wherein the front surface of the second hanging portion comprises a second visual characteristic that is different from the first visual characteristic.

16. The necktie system of claim 10, wherein a maximum width of the first portion is at least double a maximum width of the second portion.

* * * * *